United States Patent · [19]

Shimoya

[11] Patent Number: 4,700,178

[45] Date of Patent: Oct. 13, 1987

[54] A.C. ALARM BUZZER

[75] Inventor: Shigeo Shimoya, Kitamoto, Japan

[73] Assignee: Kobishi Electric Co., Ltd., Tokyo, Japan

[21] Appl. No.: 746,094

[22] Filed: Jun. 18, 1985

[51] Int. Cl.[4] ..... G10K 1/062

[52] U.S. Cl. ..... 340/402; 340/384 R; 340/388; 340/404

[58] Field of Search ..... 340/384 R, 391, 392, 340/393, 388, 396, 401–404; 116/148, 149, 152

[56] References Cited

U.S. PATENT DOCUMENTS

| | | | |
|---|---|---|---|
| Re. 31,152 | 2/1983 | Sakaguchi et al. | 340/388 |
| 2,012,818 | 8/1935 | Hueber et al. | 340/404 |
| 2,041,925 | 5/1936 | Heath | 340/404 |
| 2,700,761 | 1/1955 | White et al. | 340/403 |
| 3,533,103 | 10/1970 | Hayden | 340/402 |
| 3,540,039 | 11/1970 | McCarty, Jr. et al. | 340/402 |
| 4,005,413 | 1/1977 | Berns | 340/402 |
| 4,097,861 | 6/1978 | Pariza | 340/388 |
| 4,136,337 | 1/1979 | Larime | 340/402 |
| 4,199,752 | 4/1980 | Lucas et al. | 340/402 |
| 4,410,881 | 10/1983 | Seyler | 340/402 |

*Primary Examiner*—James L. Rowland
*Assistant Examiner*—Brent A. Swarthoot
*Attorney, Agent, or Firm*—Kane, Dalsimer, Kane, Sullivan and Kurucz

[57] ABSTRACT

An alarm buzzer includes a bobbin mounted within a housing and having a base portion and a hollow cylindrical portion. The mounting plate is interposed between the bottom wall and the base portion. A coil is wound around the cylindrical portion, and opposite ends of the coil are connected respectively to a pair of terminals mounted on the base portion. An iron core extends through the cylindrical portion of the bobbin and is held in engagement with the bobbin and the bottom wall, thereby holding the bobbin and the mounting plate against movement with respect to the housing. An armature is resiliently supported on the mounting plate for being attracted into the core upon energization of the electromagnet. Upon de-energization of the electromagnet, the armature is returned into striking contact with a vibratory plate to produce a sound under the restoring force of the resilient means.

1 Claim, 6 Drawing Figures

A.C. ALARM BUZZER

BACKGROUND OF THE INVENTION

1. Field of the Invention

This invention relates to an alarm buzzer for producing a buzzing sound in an emergency such as a fire and burgulary.

2. Prior Art

One conventional alarm buzzer 100 (FIGS. 1 and 2) as disclosed in U.S. Pat. No. Re. 31,152 is of the type designed to be operated by DC power source and comprises a cup-shaped housing 102 of electrically conductive material, a dish-shaped horn 104 attached to an open end of the housing 102, a vibratory plate 105 of electrically-conductive material clamped between the housing 102 and the horn 104, and an electromagnet 106 mounted within the housing 102. An insulating plate 108 is placed on the bottom of the housing 102, and a yoke 110 is mounted on the insulating plate 108, the yoke 110 having a base portion 110*a* held against the insulating plate 108 and a pair of opposed inverted L-shaped arms 110*b*. A bobbin 112 of an electrically-insulating material is mounted on the yoke 110, the bobbin 112 having a base portion 112*a* held against the base portion 110*a* of the yoke 110 and a hollow cylindrical portion 112*b* formed on the base portion 112*a* and having a flange 112*c* formed on the free end of the cylindrical portion 112*b*. A coil 116 is wound around the cylindrical portion 112*b*, and an iron core 118 is inserted in the tubular portion 112*b*. The upper legs of the opposed arms 110*b* directed toward each other are held against the flange 112*c* of the bobbin 112. The yoke 110 has a mounting portion 110*c* extending perpendicularly from the base portion 110*a*, and an armature 120 is mounted on the mounting portion 110*c* through a leaf spring 122, the armature 120 being disposed in opposed relation to the upper end of the core 118 and the upper leges of the arms 110*b*. A pair of tubular projections 112*d* are formed on the base portion 112*a* of the bobbin 112, and pass through the base portion 110*a* of the yoke 110 and the insulating plate 108. A first lug terminal 124 is held in contact with the outer surface of the bottom wall of the housing 102 by a rivet 126 passing through the tubular projection 112*d* and the bottom wall of the housing 102. Another rivet 128 passes through the other tubular projection 112*d*. Thus, the bobbin 102, the yoke 110 and the insulating plate 108 are fixed with respect to the housing 102 by the two rivets 126 and 128. And, the yoke 110 is electrically insulated from the housing 102. A tubular projection 112*e* is also formed on the base portion 112*a* of the bobbin 112 and passes through the base portion 110*a* of the yoke 110, the insulating plate 108 and the bottom wall of the housing 102. A terminal 130 in the form of a strip extends through the tubular projection 112*e*. One end of the terminal 130 disposed in the housing 102 is electrically connected to one end of the coil 116, the other end of the coil 116 being electrically connected to the yoke 110. The terminals 124 and 130 are electrically connected to a DC power source. A first contact 132 is secured to the armature 120, and a second contact 134 is formed on the vibratory plate 105. When an electrical potential is applied across the terminals 124 and 130 from the DC power source, the electromagnet 106 consisting of the coil 116 and the core 118 is energized so that the armature 120 is attracted by the core 118 against the bias of the leaf spring 122 to bring the first contact 132 out of contact with the second contact 134 to de-energized the electromagnet 106 whereupon the armature 120 is brought into striking engagement with the vibratory plate 105 under the restoring force of the spring 122. This operation is repeated to produce a buzzing sound.

It has now been desired to provide an alarm buzzer analogous to the above-mentioned conventional buzzer but capable of being operated by an AC power source.

SUMMARY OF THE INVENTION

It is therefore an object of this invention to provide an alarm buzzer of the type which can be powered by an AC power source with less component parts.

According to the present invention, there is provided an alarm buzzer comprising:

(a) a housing having a bottom wall;

(b) a bobbin of an electrically insulating material mounted within the housing and having a base portion and a hollow cylindrical portion formed on said base portion;

(c) a mounting plate interposed between the base portion and the bottom wall;

(d) an electromagnet comprising an coil wound around the cylindrical portion and an iron core extending through the cylindrical portion of the bobbin and held in engagement with the bobbin and the bottom wall, thereby holding the bobbin and the mounting plate against movement with respect to the housing;

(e) a pair of electrical terminals mounted on the base portion, opposite ends of the coil being electrically connected to the terminals, respectively, and the terminals being connectable to a power source;

(f) a vibratory plate mounted on the housing;

(g) an armature; and (h) means for resiliently supporting the armature on the mounting portion and normally urging the armature away from the core;

(i) whereby upon energization of the electromagnet, the armature is attracted to the core against the bias of the resilient means, upon de-energization of the electromagnet, the armature is moved into striking contact with the vibratory plate under the restoring force of the resilient means to produce a sound.

DESCRIPTION OF THE PREFERRED EMBODIMENT OF THE INVENTION

Figure 3:
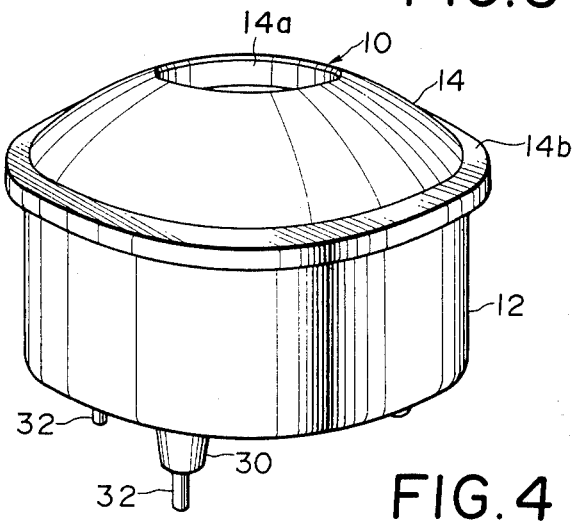
FIG. 3 is a perspective view of an alarm buzzer provided in accordance with the present invention.
Figure 4:
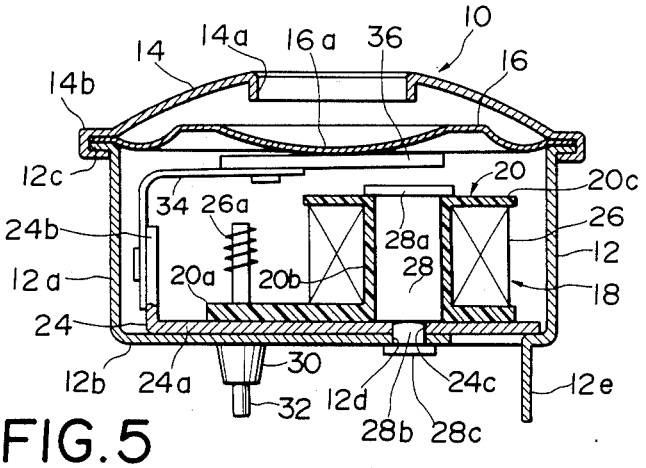
FIG. 4 is a cross-sectional view of the alarm buzzer of FIG. 3.

An alarm buzzer 10 shown in FIGS. 3 and 4 comprises a cup-shaped housing 12 having a peripheral wall 12*a*, a bottom wall 12*b* and a peripheral flange 12*c* formed at one end of the peripheral wall 12*a* remote from the bottom wall 12*b*, a dish-shaped horn 14 having a central aperture 14*a* and a peripheral flange 14*b* of a channel-shaped cross-section fitted on the flange 12*c* of the housing 12, a vibratory disc 16 clamped between the flanges 12*c* and 14*b* at an periphery thereof, and an electromagnet 18 mounted within the housing 12.

Figure 5:
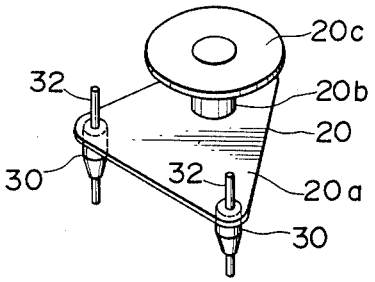
FIG. 5 is a perspective view of a bobbin incorporated in the alarm buzzer.

A bobbin 20 made of an electrically insulating material such as a synthetic resin is mounted on the bottom wall 12*b* of the housing 12, the bobbin 20 having a base plate portion 20*a* of a generally triangular shape (FIGS. 5 and 6) and a hollow cylindrical portion 20*b* extending perpendicularly from the base portion 20*a*, the cylindrical portion 20*b* having opposite open ends and having a flange 20*c* at its free end. An L-shaped mounting plate 24 defined by first and second legs 24*a* and 24*b* is mounted on the housing 12 with the first leg 24*a* interposed between the bottom wall 12*b* of the housing 12 and the base portion 20*a* of the bobbin 20.

A coil 26 is wound around the cylindrical portion 20*b* of the bobbin 20, and an iron core 28 is fitted in the cylindrical portion 20*b*. The electromagnet 18 is constituted by the coil 26 and the iron core 28. The core 28 has at one end a flange 28*a* held against the flange 20*c* of the bobbin 20, the core 28 having a reduced diameter portion 28*b* at the other end. The reduced diameter portion 28*b* extends through aligned apertures 24*c* and 12*d* formed respectively through the first leg 24*a* of the mounting plate 24 and the bottom wall 12*b* of the housing 12, the reducing diameter portion 28*b* having at its free end a flange 28*c* held in firm engagement with the outer surface of the housing bottom wall 12*b* , thereby fixing the bobbin 20 and the mounting plate 24 with respect to the housing 12.

Figure 6:
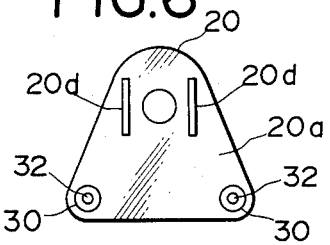
FIG. 6 is a bottom plan view of the bobbin.

As shown in FIG. 6, the bobbin 20 has a pair of parallel spaced ribs or ridges 20*d* which are formed on the surface of the base portion 20*a* facing away from the cylindrical portion 20*b*. The first leg 24*a* of the L-shaped mounting plate 24 sandwiched between the base portion 20*a* and the housing bottom wall 12*b* is disposed between the pair of ridges 20*d* with the lateral edges thereof disposed in contiguous relation to the respective ridges 20*d*, thereby positively preventing the lateral movement of the mounting plate 24 with respect to the bobbin 20. The height of each ridge 20*d* is slightly less than the thickness of the mounting plate 24 of a uniform thickness.

A pair of projections 30 extend perpendicularly from the surface of the base portion 20*a* facing away from the cylindrical portion 20*b*, the projections 30 being disposed at two corners of the base portion 20*a* remote from the cylindrical portion 20*b*. A pair of electrical terminals 32 in the form of a pin extend through the base portion 20*a* and the respective projections 30 axially. The terminals 32 are fixed to the respective projections 30, and the projections 30 are fitted respectively in apertures (not shown) formed through the bottom wall 12*b* of the housing. The opposite ends 26*a* of the coil 26 are wound around the terminals 32, respectively, to make electrical connection thereto and are fixed by soldering. The pair of terminals 32 are electrically connected to an AC power source so that the electromagnet 18 can be energized.

An L-shaped resilient member or leaf spring 34 is fixedly secured at one end to the second leg 24*b* of the mounting plate 24, and an armature 36 in the form of a plate is fixedly secured to the other end of the leaf spring 30. The armature 36 is normally disposed in opposed relation to the flange 28*a* of the core 28 and is resiliently urged by the leaf spring 34 into contact with a central bulged portion 16*a* of the vibratory plate 16. A stamped-out lug 12*e* is formed on the bottom wall 12*b* of the housing 12 so as to serve as a grounding terminal.

In operation, when an electrical potential is applied across the pair of terminals 32 from the AC power source, the electromagnet 18 is energized, so that the armature 36 is attracted into contact with the flange 28*a* of the iron core 28 against the bias of the leaf spring 34. The electromagnet 18 is repeatedly de-energized at a constant frequency because of the use of the alternating current. Upon de-energization of the electromagnet 18, the armature 36 is moved into striking contact with the bulged portion 16*a* of the vibratory disc 16 under the restoring force of the leaf spring 34, thereby producing a buzzing sound.

Figure 1:
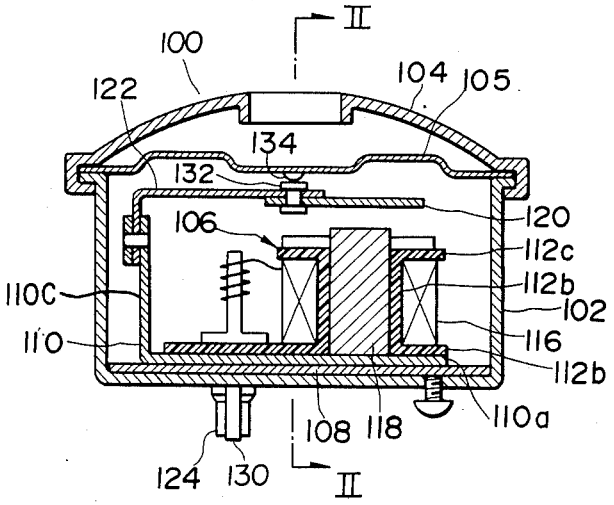
FIG. 1 (Prior Art)
FIG. 1 is a cross-sectional view of an alarm buzzer provided in accordance with the prior art.
Figure 2:
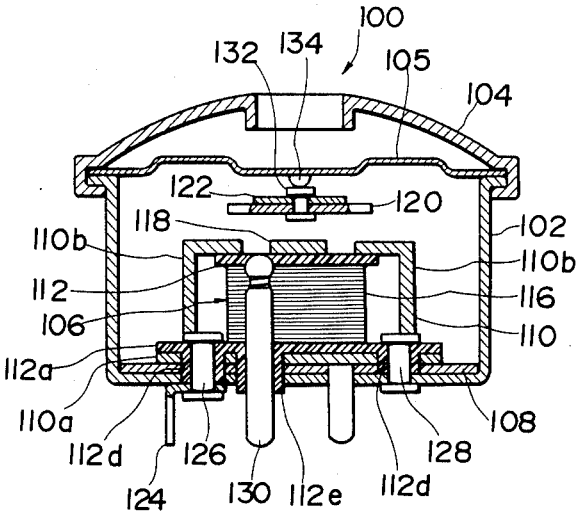
FIG. 2 (Prior Art)
FIG. 2 is a cross-sectional view taken along the line II—II of FIG. 1.

As described above, according to the present invention, the bobbin 20 and the mounting plate 24 are fixed to the housing 12 only by the core 28, that is to say, by passing the reduced diameter portion 28*b* of the core 28 through the apertures 24*c* and 12*d* formed respectively in the first leg 24*a* of the mounting plate 24 and the housing bottom wall 12*b* and staking or deforming the free end of the reduced diameter portion 28*b* into the flange 28*c*. Thus, the number of component parts of the alarm buzzer 10 is less and the conventional alarm buzzer of FIGS. 1 and 2 and therefore can be manufactured easily and inexpensively.

What is claimed is:

1. An alarm buzzer comprising:

(a) a housing of metal having a bottom wall;

(b) a bobbin of an electrically insulating material mounted within said housing and having a base portion and a hollow cyclindrical portion formed on one side of said base portion, said bobbin has a pair of projections extending through said bottom wall;

(c) a mounting plate interposed between the other side of said base portion and said bottom wall;

(d) an electromagnet comprising a coil wound around said hollow cylindrical portion and an iron core extending through said cylindrical portion of said bobbin and held in engagement with said bobbin and said bottom wall, thereby holding said bobbin and said mounting plate against movement with respect to said housing, said core has first and second flanges formed on opposite ends thereof, said first flange engaging one end of said cylindrical portion of said bobbin remote from said base portion while said second flange engages the outer surface of said bottom wall facing away from said bobbin;

(e) a pair of electrical terminals mounted on said base portion and electrically insulated from said housing, opposite ends of said coil being electrically connected to said terminals, respectively, said terminals being elongated and extending through said projections, respectively, and said terminals being connectable to an AC power source;

(f) a vibratory plate mounted on said housing;

(g) an armature, said armature being attracted by said first flange when said electromagnet is energized; and (h) means for resiliently supporting said armature on said mounting portion and normally urging said armature away from said core said mounting portion is an L-shaped plate defined by a first leg and a second leg, said first leg being interposed between said bottom wall and said other side of said base portion of said bobbin, said base portion having a pair of parallel spaced ridges formed on said other side thereof facing said bottom wall, lateral edges of said first leg being disposed in contiguous relation to the respective ridges to prevent the lateral movement of said mounting plate with respect to said bobbin;

(i) wherby upon energization of said electromagnet, said armature is attached to said core against the bias of said resilient means, upon de-energization of said electromagnet, said armature is moved into striking contact with said vibratory plate under the restoring force of said relilient means to produce a sound.

* * * * *